US008712280B2

(12) United States Patent
Kuruma et al.

(10) Patent No.: US 8,712,280 B2
(45) Date of Patent: Apr. 29, 2014

(54) IMAGE FORMING APPARATUS ASSEMBLED WITH A FIXING MEMBER AND A PRESSING MEMBER

(75) Inventors: Tomoya Kuruma, Mishima (JP); Tomio Noguchi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 303 days.

(21) Appl. No.: 13/194,219

(22) Filed: Jul. 29, 2011

(65) Prior Publication Data

US 2012/0033989 A1 Feb. 9, 2012

(30) Foreign Application Priority Data

Aug. 4, 2010 (JP) ..... 2010-175554
Jul. 25, 2011 (JP) ..... 2011-162024

(51) Int. Cl.
*G03G 15/00* (2006.01)
*H05K 5/00* (2006.01)

(52) U.S. Cl.
USPC ..... 399/107; 312/223.2; 361/679.02

(58) Field of Classification Search
USPC ..... 399/107, 110, 126, 411; 174/560, 562; 361/724, 728, 679.02; 312/223.2, 312/348.2
See application file for complete search history.

(56) References Cited

U.S. PATENT DOCUMENTS

| | | | | | |
|---|---|---|---|---|---|
| 5,570,159 | A * | 10/1996 | Hirose et al. | 399/107 |
| 5,778,734 | A * | 7/1998 | Uchida | 74/552 |
| 6,580,886 | B1 * | 6/2003 | Howard et al. | 399/110 |
| 6,968,606 | B2 * | 11/2005 | Fromm et al. | 29/434 |
| 7,835,663 | B2 * | 11/2010 | Tomatsu | 399/107 |
| 2007/0104554 | A1 | 5/2007 | Ishino et al. | |
| 2011/0052251 | A1 * | 3/2011 | Kondo | 399/107 |
| 2011/0102983 | A1 * | 5/2011 | Souda et al. | 361/679.01 |

FOREIGN PATENT DOCUMENTS

| | | | |
|---|---|---|---|
| JP | 07071424 | A * | 3/1995 |
| JP | 07210062 | A * | 8/1995 |
| JP | 08-284910 | A | 11/1996 |
| JP | 10-299735 | A | 11/1998 |
| JP | 10-306813 | A | 11/1998 |
| JP | 10-306814 | A | 11/1998 |
| JP | 11-095510 | A | 4/1999 |
| JP | 2001018482 | A * | 1/2001 |
| JP | 2004-286072 | A | 10/2004 |
| JP | 4244316 | B2 | 3/2009 |

* cited by examiner

*Primary Examiner* — Robert Beatty
(74) *Attorney, Agent, or Firm* — Fitzpatrick, Cella, Harper & Scinto

(57) ABSTRACT

In order to improve a fixing accuracy, provided is an image forming apparatus including a pressing member pressing a first frame and a second frame so that an abutment portion of the first frame abuts on the second frame, wherein the first frame and the second frame are pressed by the pressing member urged by a fixing member, and the second frame abuts on the abutment portion of the first frame.

11 Claims, 11 Drawing Sheets

IMAGE FORMING APPARATUS ASSEMBLED WITH A FIXING MEMBER AND A PRESSING MEMBER

BACKGROUND OF THE INVENTION

1. Field of the Invention

The present invention relates to an image forming apparatus including a structure in which two members are coupled to each other by a fixing member.

2. Description of the Related Art

In a structure of a copying machine, a FAX, a printer, or the like, multiple members are combined, and those members are fixed to each other by fastening means such as welding, screw fastening, or a rivet.

For example, in a case of welding, members are melted for fixation, and hence the coupled portion shows high strength. However, the welding requires large-scale equipment, and hence cost increases. Further, there is a problem of deterioration of accuracy due to heat deformation. Instead of the welding, screw fastening or rivet fastening may be used. Usually, in a case of fastening two members to each other with a screw or rivet, a diameter of a hole through which the screw or rivet is to be inserted is made larger than an outer diameter of an insertion portion of the screw or rivet. With this, a sufficient allowance is ensured between the insertion portion and the hole at the time of insertion. The reason is to insert the rivet or screw easily, and to prevent a cost increase resulting from an increase in dimensional accuracy. However, in a case of the screw fastening or rivet fastening, when the diameter of the hole has an allowance, a gap corresponding to the allowance remains after the fastening. Thus, when large load is applied to the coupled portion, there has been a problem in that slippage occurs at the coupled portion.

In order to solve this problem, the following blind rivet has been proposed. A step is formed on each of a mandrel of the blind rivet and an inside of a body for receiving the rivet, and the outer diameter of the stepped portion of the mandrel is increased toward the stepped portion of the body in a fixing process. With this configuration, it is possible to eliminate a gap that occurs between the members after fixation, and to effect fixation in which both the members coupled to each other with the blind rivet do not change in relative positions with time. In order to increase versatility of this technology, Japanese Patent Application Laid-Open No. 2004-286072 proposes the following configuration. The tubular projection is provided on one fixing member, the hole portion is provided in the other fixing member, and the screw having a diameter larger than the inner diameter of the tubular projection is press-fitted into the inside (hollow portion) of the tubular projection fitted into the hole portion. With this configuration, by press-fitting the screw, the tubular projection can be expanded, and the gap between the tubular projection and the hole portion can be eliminated. In addition, the related art includes technologies disclosed in Japanese Patent Application Laid-Open No. H10-299735, Japanese Patent Application Laid-Open No. H10-306813, Japanese Patent Application Laid-Open No. H10-306814, and Japanese Patent No. 4244316.

In the above-mentioned conventional examples, two components are fixed to each other to prevent backlash from occurring at the fixing portion of the two components, and hence a fixing accuracy varies due to a projection shape before fixation, a position of a hole shape, and deformation generated in an expanding process.

Assuming that the two components are processed by general press working, the following variation occurs. In a case of forming the tubular projection, primary processing of performing a punching step and secondary processing of drawing the projecting portion are carried out. In the primary processing, portions required for a positional accuracy are processed simultaneously, with the result that the portions are finished to have highly accurate dimensions (for example, ±0.1 or less). In the secondary processing, the projecting portion is processed to have a drawn shape, and hence the dimensional accuracy tends to deteriorate (for example, ±0.2 or less). With the result of the primary processing and the secondary processing, the required dimensional accuracy becomes a position variation approximate to the total value (about 0.3 if the above-mentioned two accuracies are obtained).

In addition, as a fixing principle, there is required deformation due to the expanding process for reducing backlash. This deformation generates variations in fixing positions of the two components, and its numerical regulation is not easy. There is no problem if the two components are not required for a high fixing accuracy. However, as a fixing accuracy of a structure of an image forming apparatus, the accuracy of a single component with the result of the primary processing needs to be reproduced at it is. In particular, in a color LBP using a belt mechanism, in order to maintain stability of running of the belt and to set color shift among four colors within a certain allowed value or less, a positional accuracy of the structure is used as an important parameter.

SUMMARY OF THE INVENTION

The present invention provides a structure capable of increasing a fixing accuracy while suppressing cost.

The present invention provides an image forming apparatus, including: a first frame and a second frame to be fixed to each other, the first frame having an abutment portion; a fixing member to be inserted into holes respectively formed in the first frame and the second frame, the fixing member fixing the first frame and the second frame to each other, wherein the second frame abuts on the abutment portion of the first frame to determine relative positions of the first frame and the second frame in a direction intersecting an inserting direction of the fixing member; and a pressing member for pressing the first frame and the second frame so that the abutment portion of the first frame abuts on the second frame, wherein the first frame and the second frame are pressed by the pressing member which is urged by the fixing member, and the second frame abuts on the abutment portion of the first frame.

Further features of the present invention will become apparent from the following description of exemplary embodiments with reference to the attached drawings.

DESCRIPTION OF THE EMBODIMENT

Hereinafter, with reference to the drawings, a mode for carrying out the present invention is described in detail by way of example based on an embodiment. Note that, dimensions, materials, shapes, and relative arrangement of components described in this embodiment are modified as needed depending on various conditions and a configuration of an apparatus to which the invention is applied, and should not be construed as limiting the scope of the invention to the following embodiment.

EMBODIMENT

Figure 1:
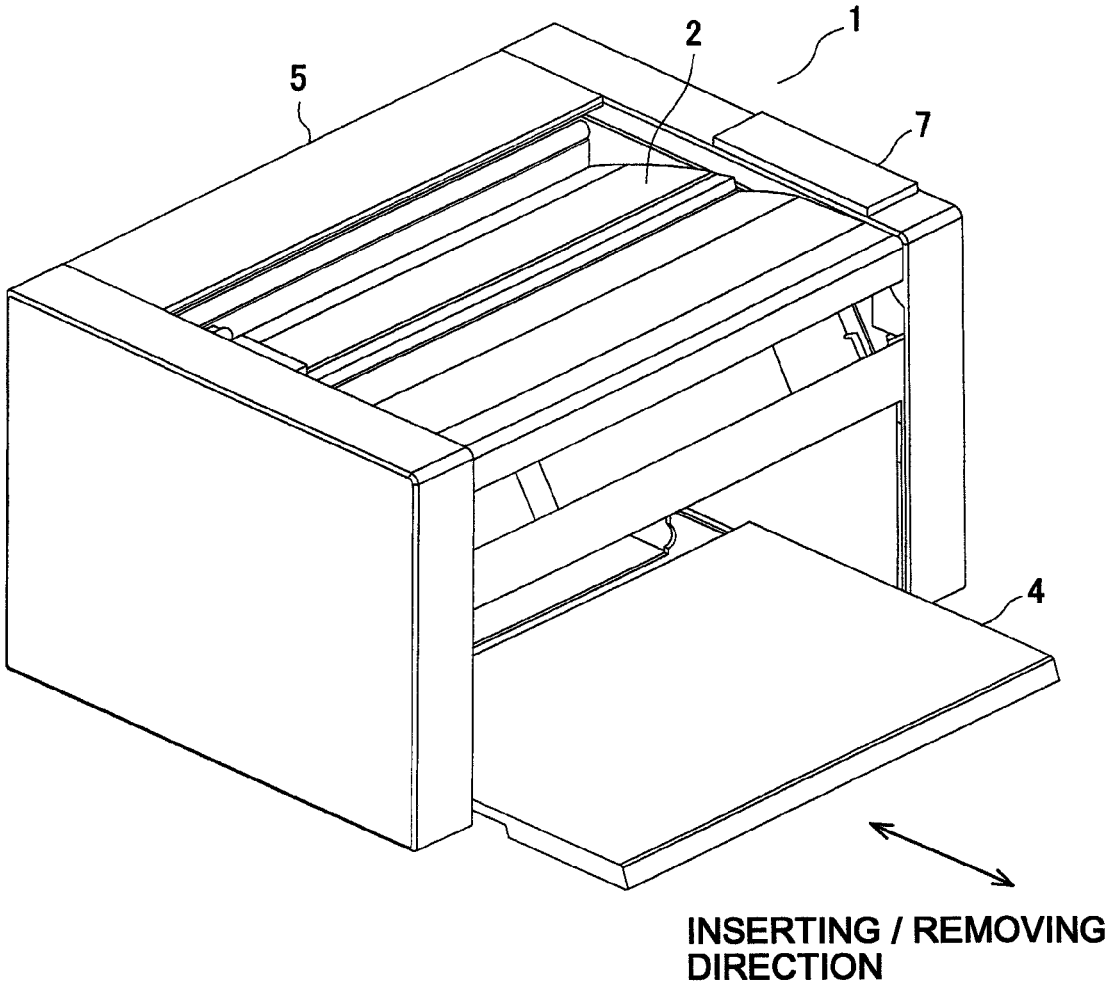
FIG. 1 is a perspective view of an external appearance of an image forming apparatus according to an embodiment of the present invention.
Figure 2:
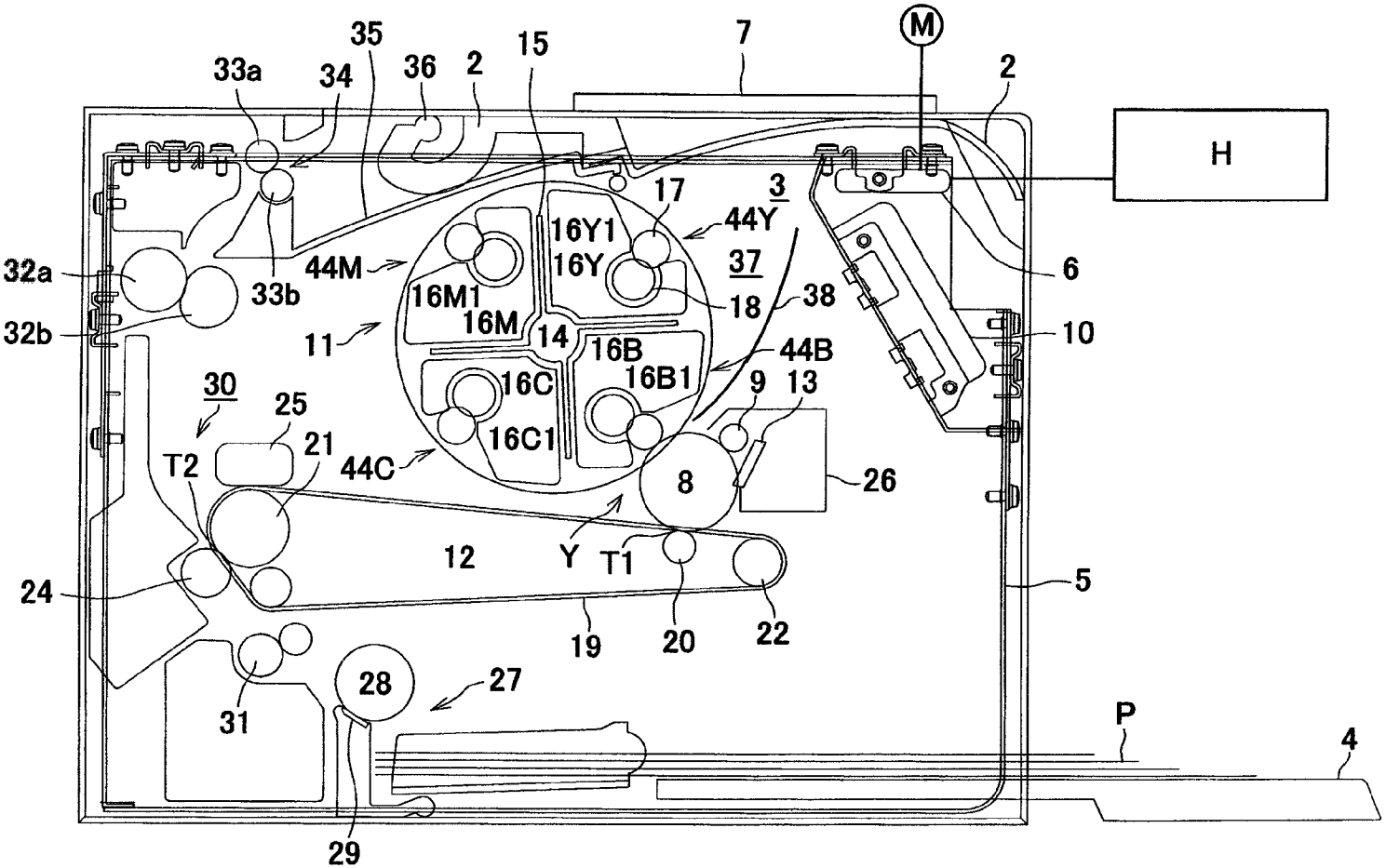
FIG. 2 is a sectional view of a main part of the image forming apparatus according to the embodiment of the present invention.
Figure 3A:
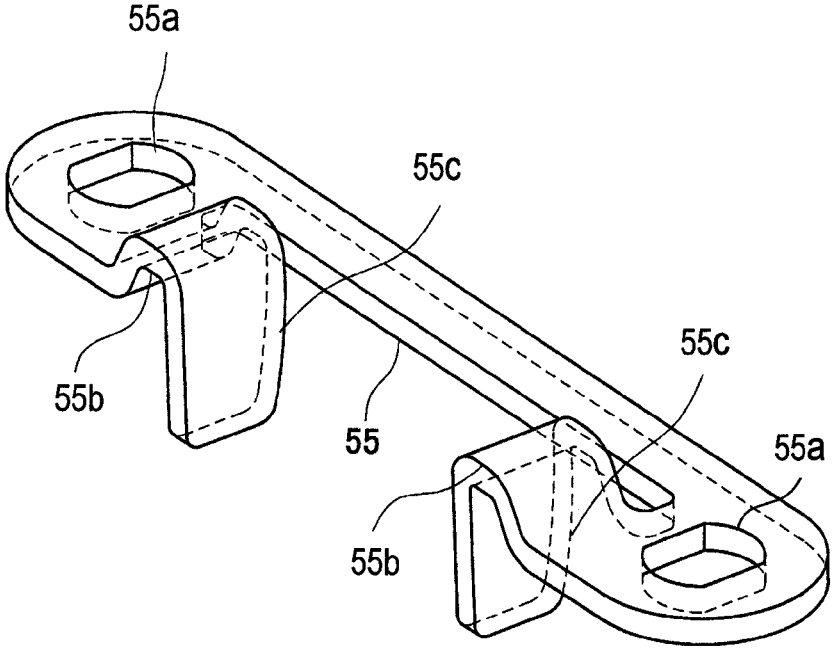
FIGS. 3A and 3B are each a perspective view of a pressing member according to the embodiment of the present invention.
Figure 3B:
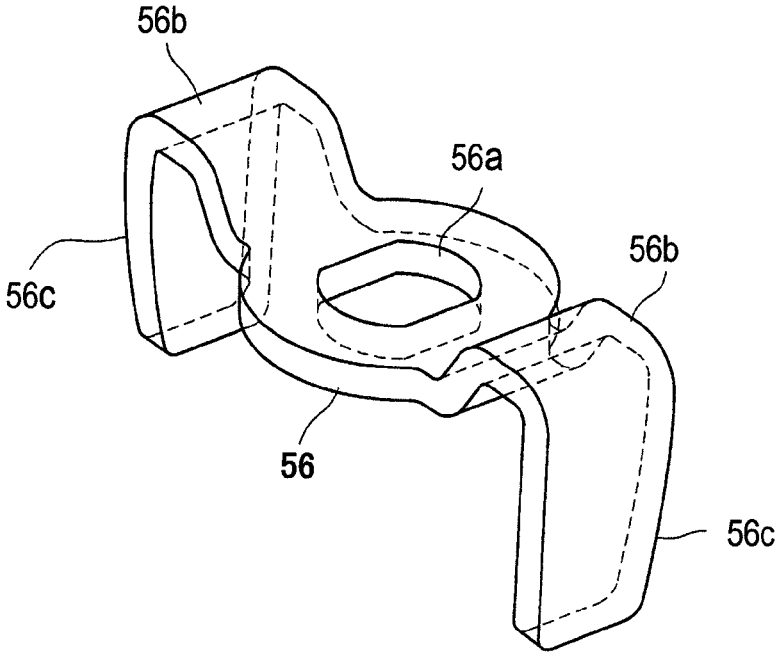
Figure 4:
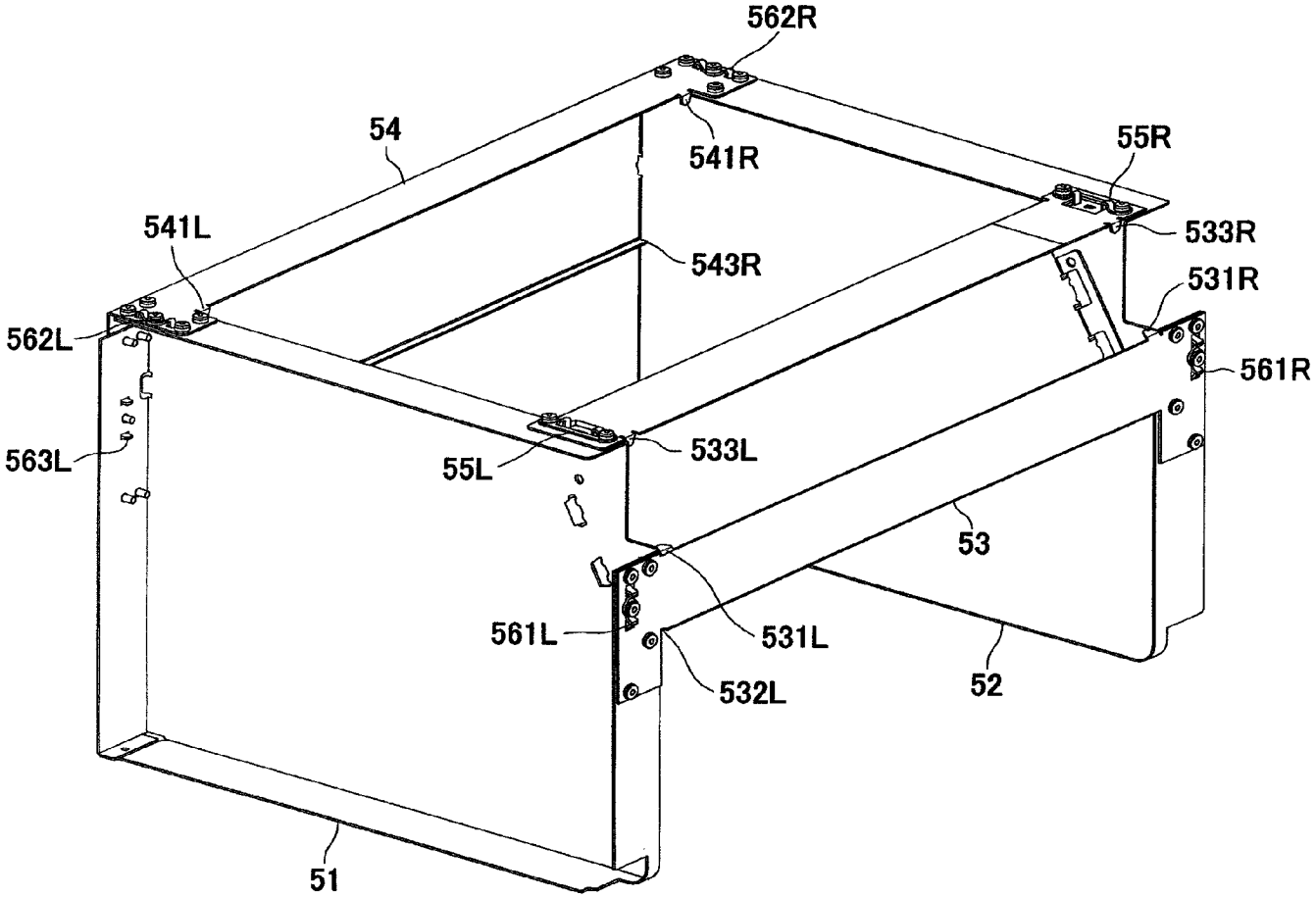
FIG. 4 is a perspective view of a structure according to the embodiment of the present invention.
Figure 5:
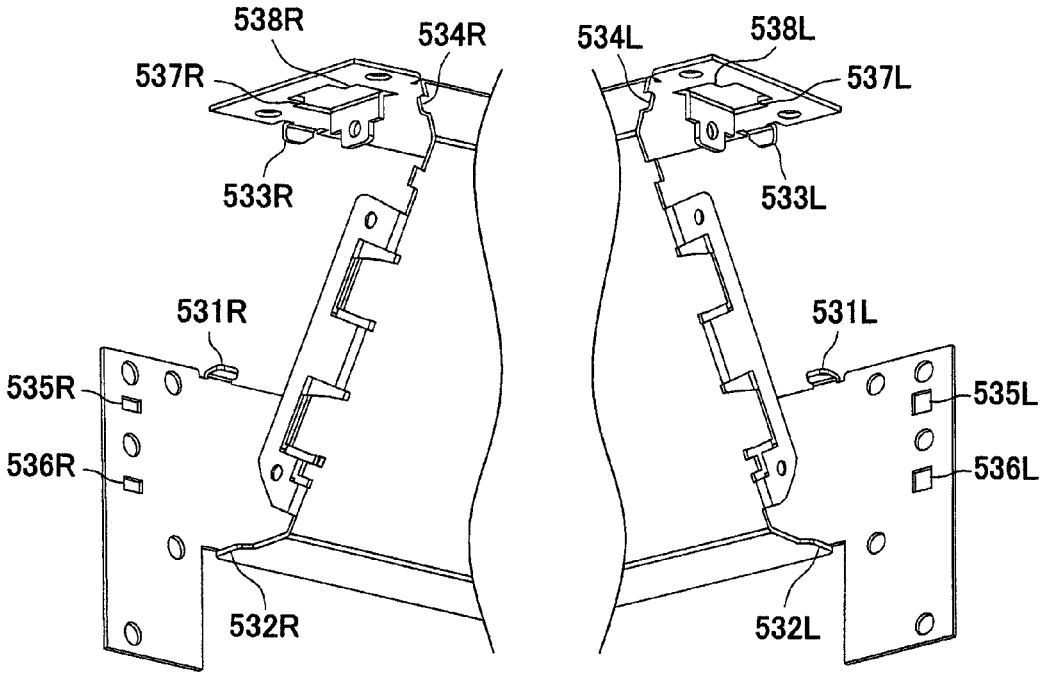
FIG. 5 is a perspective view of a part of a front stay.
Figure 6:
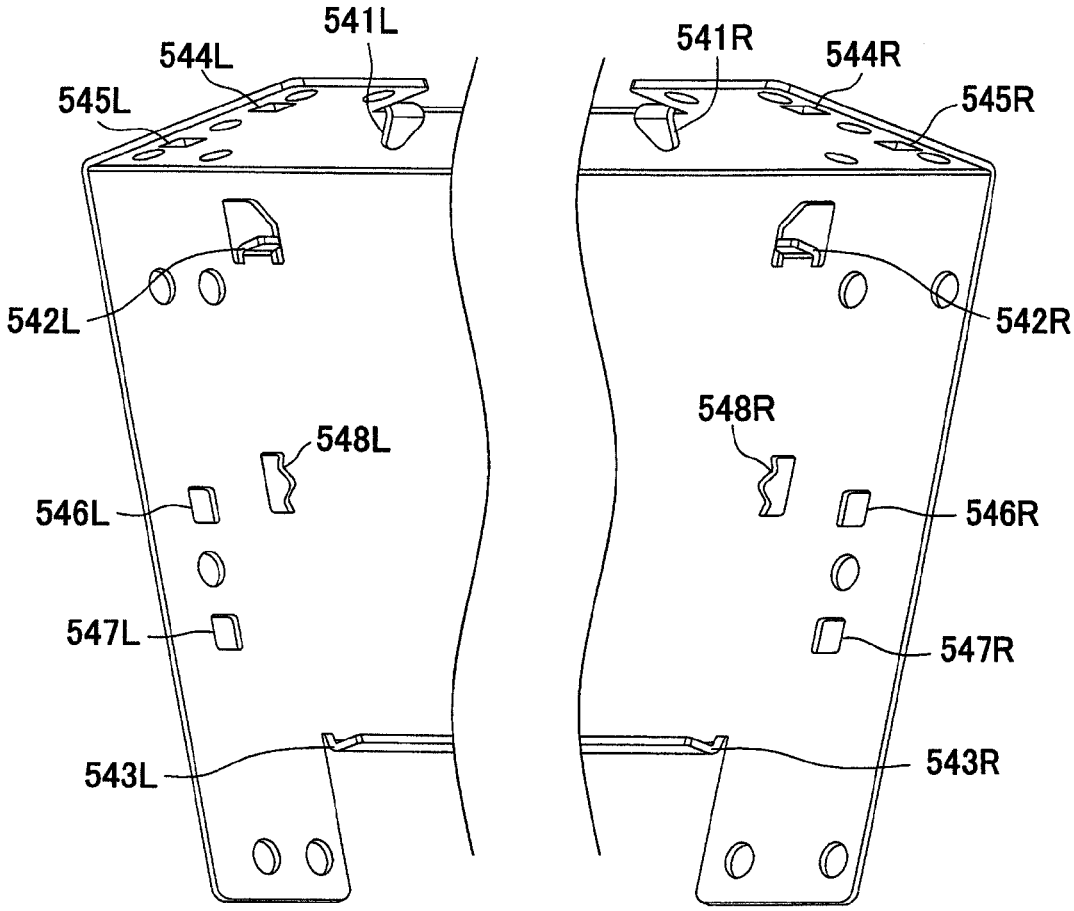
FIG. 6 is a perspective view of a part of a rear stay.
Figure 7:
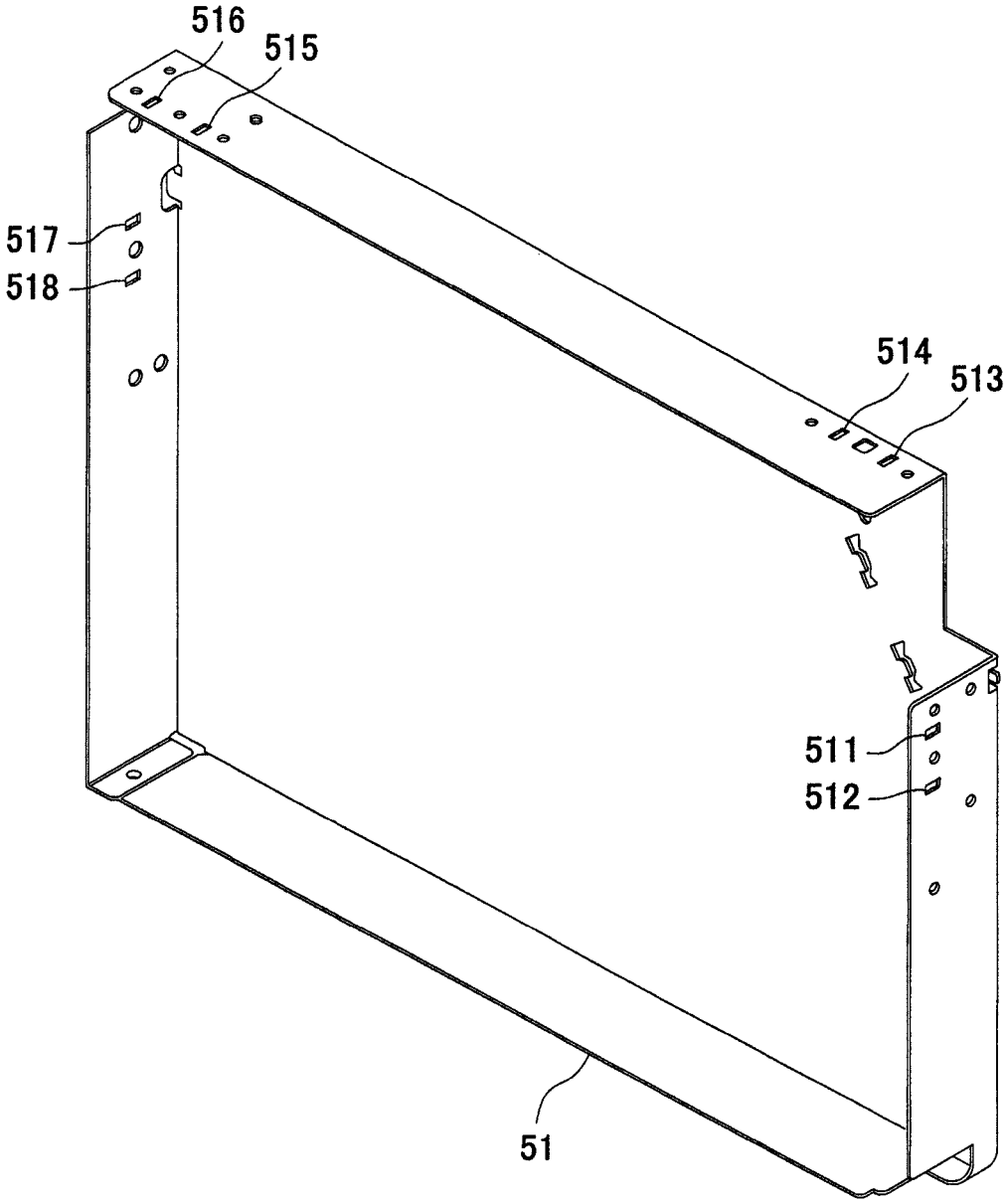
FIG. 7 is a perspective view of a left frame.
Figure 8:
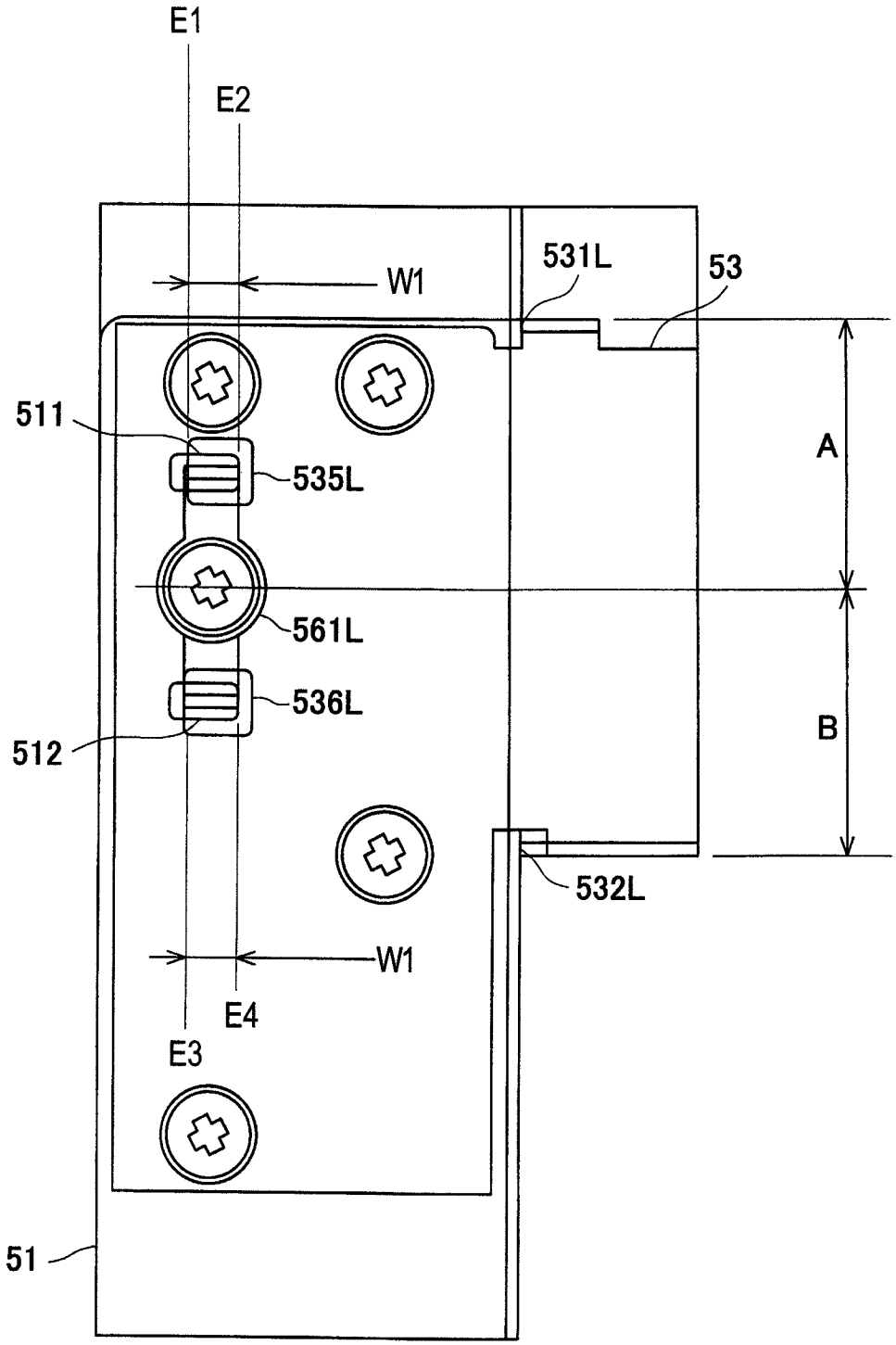
FIG. 8 is a detailed schematic view of fixing holes.
Figure 9A:
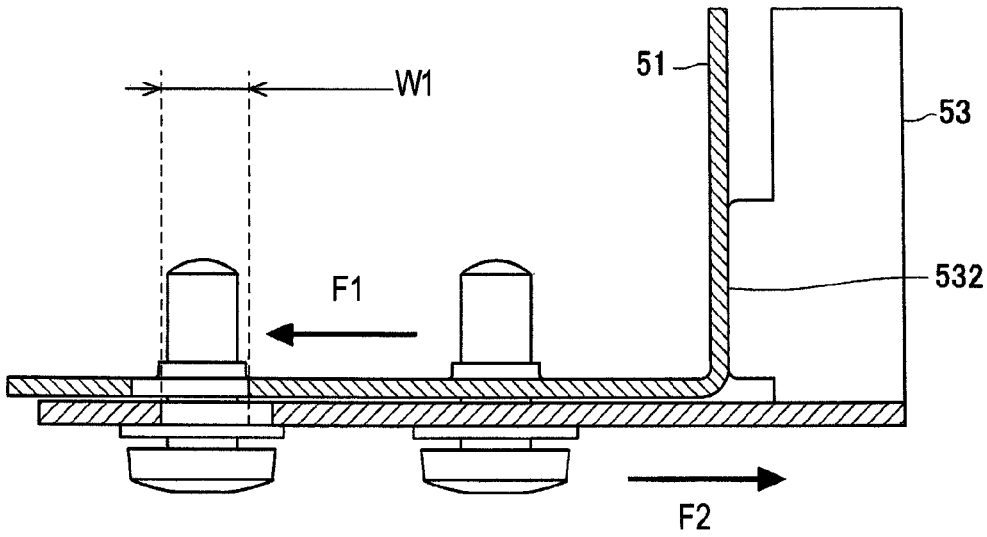
FIGS. 9A and 9B are schematic views illustrating fixing principles.
Figure 9B:
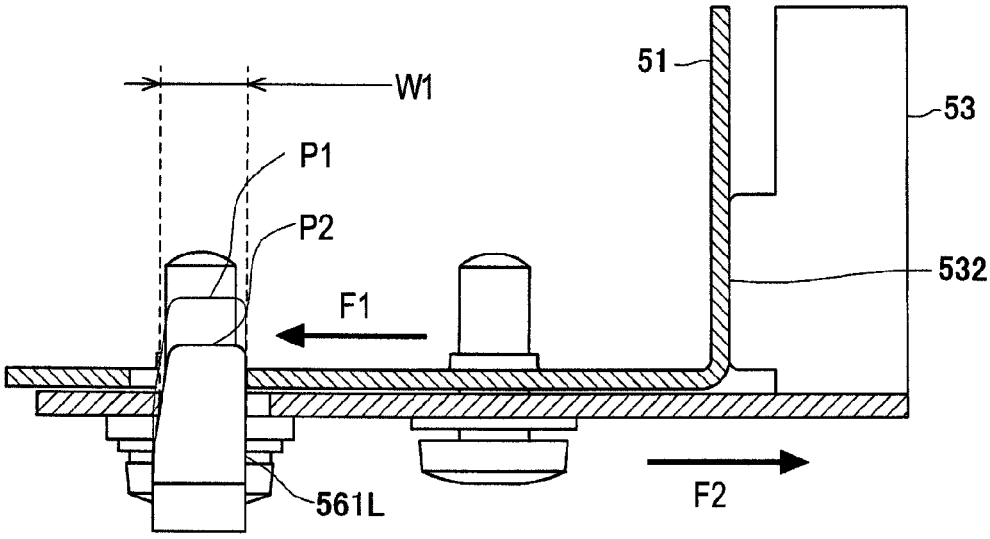
Figure 10:
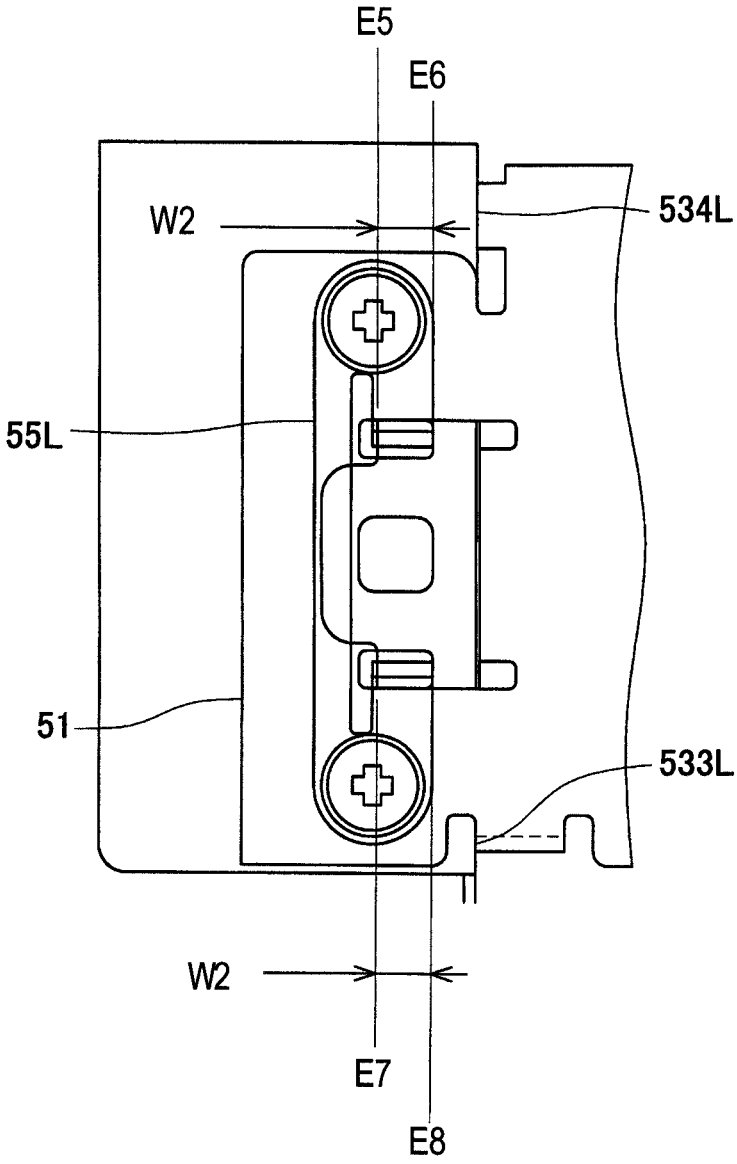
FIG. 10 is a detailed schematic view of the fixing holes.
Figure 11:
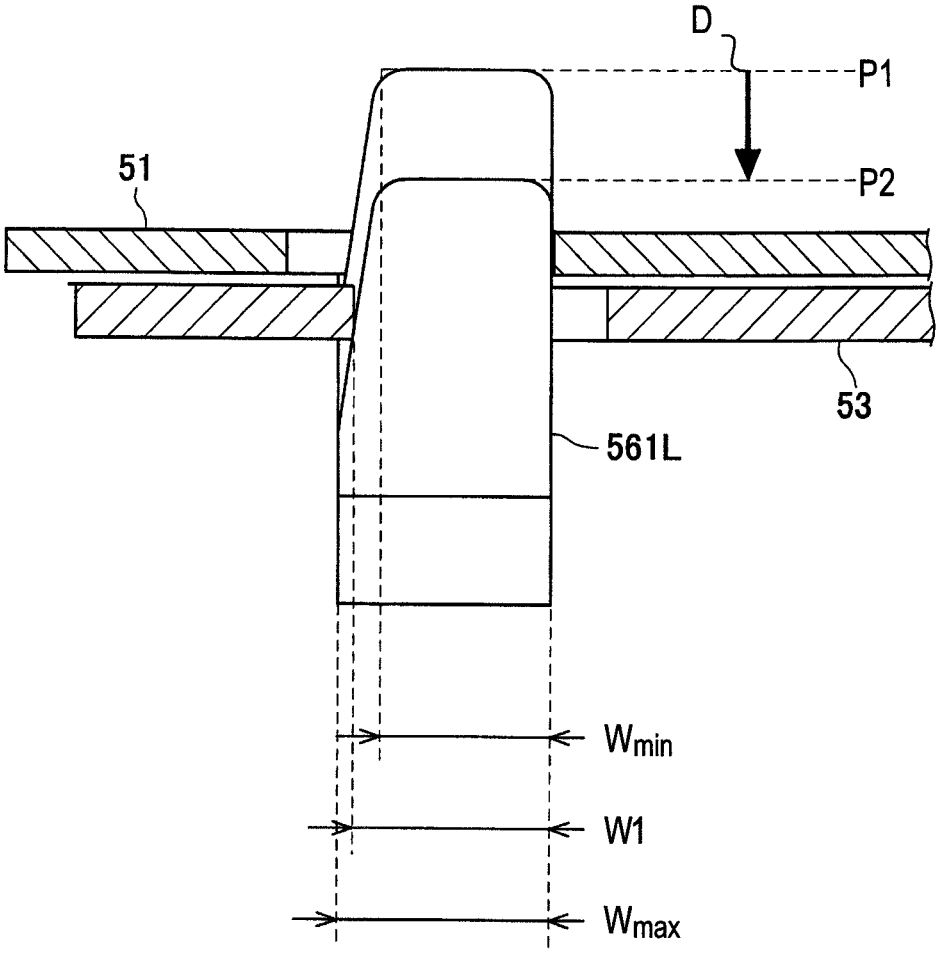
FIG. 11 is a schematic view illustrating a bending state of the pressing member.

FIG. 1 is a perspective view of an external appearance of a color electrophotographic image forming apparatus 1 according to an embodiment of the present invention. FIG. 2 is a left-side longitudinal sectional view (a sectional view of a main part) of the image forming apparatus 1. FIGS. 3A and 3B are each a perspective view of a pressing member according to the embodiment of the present invention. FIG. 4 is a perspective view of a structure according to the embodiment of the present invention. FIG. 5 is a perspective view of a part of a front stay, and right and left sides of FIG. 5 partially illustrate right and left sides of the front stay, respectively. FIG. 6 is a perspective view of a part of a rear stay, and right and left sides of FIG. 6 partially illustrate right and left sides of the rear stay, respectively. FIG. 7 is a perspective view of a left frame. FIG. 8 is a detailed schematic view of fixing holes. FIGS. 9A and 9B are schematic views illustrating fixing principles. FIG. 10 is a detailed schematic view of the fixing holes. FIG. 11 is a schematic view illustrating a bending state of the pressing member.

In the following description, regarding the image forming apparatus 1, a front side refers to a side in/from which a cassette 4 for a recording medium is inserted/removed. A rear side refers to a side opposite to the front side. A front and rear direction refers to a direction (forward direction) from the rear side to the front side of the apparatus, and a direction (rearward direction) reverse thereto. A right or left side refers to a right or left side viewed from the front of the apparatus. A right-left direction refers to a direction (left direction) from the right to the left, and a direction (right direction) reverse thereto. A drive side refers to one end side in a longitudinal direction (axis direction) of an electrophotographic photosensitive drum 8, and a non-drive side refers to the other end side thereof. An apparatus main body 5 refers to a part of the image forming apparatus other than developing cartridges 16.

The image forming apparatus 1 forms an image on the recording medium using an electrophotographic process. The image forming apparatus 1 used in this embodiment is a color laser printer capable of forming a full-color image on the recording medium. On the recording medium, an image is formed by the image forming apparatus, and examples of the recording medium include a sheet, an OHP sheet, and a label.

The image forming apparatus 1 performs image formation on a sheet-like recording medium P based on, for example, an electric image signal input from an external host apparatus H such as a personal computer, an image reader, or a facsimile to a control circuit portion (control unit: CPU) 6. The control circuit portion 6 sends/receives electric information of various types to/from the external host apparatus H and an operation portion 7 placed on the front side of a top surface of the apparatus main body 5, and controls an image forming operation of the image forming apparatus 1 according to a predetermined control program and a reference table as a whole. A motor M is also controlled by the electric signal from the control circuit portion 6.

Inside the apparatus main body 5, the electrophotographic photosensitive drum (hereinafter, referred to as drum) 8 is provided between a left frame (left side plate) 51 and a right frame (right side plate) 52 so as to be rotatable with its axis direction being along the right-left direction, the left frame 51 and the right frame 52 serving as bones of the apparatus main body 5. Around the drum 8, a charging unit 9, an exposure unit 10, a developing unit 11, a transferring unit (intermediate transfer belt unit) 12, and a drum cleaning unit 13 are provided.

The charging unit 9 uniformly charges a surface of the drum 8 to a predetermined polarity and electric potential, and a charging roller is used in this embodiment as the charging unit. The exposure unit 10 forms an electrostatic latent image on the surface of the drum 8, and a laser scanner unit is used in this embodiment as the exposure unit. The exposure unit 10 outputs laser light modulated according to image information of each color input from the external host apparatus H to the control circuit portion 6, to thereby scan and expose the surface of the drum.

The developing unit 11 develops the electrostatic latent image formed on the drum 8 as a developer image. The developing unit 11 according to this embodiment is a rotary developing device. The developing unit 11 includes a rotary (rotator, rotation support) 15, the multiple developing cartridges 16 removably mounted around the rotary 15, and a rotary transmission drive mechanism for electrically index-rotating the rotary 15. The developing device 11 includes the rotary 15 capable of index-rotating about a center shaft 14 that is bearing-supported between the left frame 51 and the right frame 52 of the apparatus main body 5 so as to be rotatable. The developing device 11 further includes the multiple developing cartridges 16 (16B, 16Y, 16M, and 16C) removably mounted around the rotary 15. In this embodiment, the developing device 11 includes four (first to fourth) developing cartridges 16B, 16Y, 16M, and 16C. The rotary 15 can hold the four developing cartridges 16 in the form of a substantially columnar unit. Further, the respective cartridges 16 are mounted onto the rotary 15 at intervals of 90° in a rotating direction of the rotary 15.

Each of the cartridges 16 includes a developing roller 17, a developer supplying roller 18 for supplying a developer t to the developing roller 17, and a developer containing portion 16B1, 16C1, 16M1, or 16Y1 containing the developer t. The developing roller 17 develops the electrostatic latent image formed on the drum 8 using the developer t contained in the developer containing portion (16B1, 16C1, 16M1, or 16Y1). Each of the cartridges 16 is removably mounted, by a user, into a corresponding accommodating portion 44 (44B, 44Y, 44M, or 44C) provided to the rotary 15. That is, each of the cartridges 16 can be attached/detached to/from the accommodating portion 44 by a user. In the first developing cartridge 16B, the developer t of black (B) color is contained in the developer containing portion 16B1. In the second developing cartridge 16Y, the developer t of yellow (Y) color is contained in the developer containing portion 16Y1. In the third developing cartridge 16M, the developer t of magenta (M) color is contained in the developer containing portion 16M1. In the fourth developing cartridge 16C, the developer of cyan (C)

color is contained in the developer containing portion 16C1. As described below, the rotary 15 rotates to sequentially move one of the multiple developing cartridges to an imaging position Y for developing the electrostatic latent image formed on the drum 8.

The transferring unit transfers the developer image formed on the surface of the drum 8 onto the recording medium P, and the intermediate transfer belt unit 12 (hereinafter, referred to as transferring unit) is used in this embodiment. The transferring unit 12 includes a flexible endless intermediate transfer belt (hereinafter, referred to as belt) 19 which serves as an intermediate transfer member and is formed of a dielectric. The transferring unit 12 includes a primary transfer roller 20, a belt drive roller 21, and a tension roller 22 which stretch the belt 19 therearound. The primary transfer roller 20 is held in press-contact with the drum 8 through the belt 19. A contact portion between the drum 8 and the belt 19 corresponds to a primary transfer nip portion T1.

A secondary transfer roller 24 is provided opposed to a portion of the belt drive roller 21 around which the belt is stretched. The secondary transfer roller 24 is moved, by a rocking mechanism, between an operation position to be held in contact with the belt drive roller 21 through the belt 19, and a non-operation position to be separated from the surface of the belt 19. The secondary transfer roller 24 is normally held at the non-operation position, and is moved to the operation position at predetermined control timing. Under a state in which the secondary transfer roller 24 is moved to the operation position, a contact portion between the secondary transfer roller 24 and the belt 19 corresponds to a secondary transfer nip portion T2.

At the portion of the belt drive roller 21 around which the belt is stretched, on a downstream side in a moving direction of the belt 19 with respect to the secondary transfer roller 24, a belt cleaner 25 for cleaning the surface of the belt 19 is provided. The belt cleaner 25 is moved, by a rocking mechanism, between an operation position at which a cleaning member is held in contact with the surface of the belt 19, and a non-operation position at which the cleaning member is separated from the surface of the belt 19. The cleaning member is normally held at the non-operation position. Further, the cleaning member is moved to the operation position at predetermined control timing.

The drum cleaning unit removes the residual developer after primary transfer from the surface of the drum 8 from which the developer image has been primarily transferred onto the belt 19. In this embodiment, a cleaning blade 13 is used as the cleaning unit 13. The cleaning blade 13 is held in contact with the surface of the drum 8, and removes the residual developer. The developer removed from the surface of the drum 8 is contained in a cleaner container 26.

A feeding unit 27 is provided below the belt unit 12. The feeding unit 27 includes the cassette 4 accommodating the recording medium P, a feed roller 28, and a separation pad 29. The cassette 4 is freely drawn in and out from the front side of the apparatus main body 5.

A conveyance path 30 extending upward is provided on the rear side of the inside of the apparatus main body 5. A registration roller unit 31, the secondary transfer roller 24, a fixing unit 32, and a delivery unit 33 are provided along the conveyance path 30 from the lower side to the upper side thereof. The fixing unit 32 includes a fixing roller 32*a* and a pressure roller 32*b*. The delivery unit 33 includes a delivery roller 33*a* and a roller 33*b*. A delivery tray 35 is provided on the top surface of the apparatus main body 5. Further, a top surface cover 2 that is openable and closable about a hinge shaft 36 is provided on the top surface of the apparatus main body 5. The recording medium P subjected to image formation is delivered by the delivery unit 33 through a delivery port 34 onto the delivery tray 35.

In the top surface of the apparatus main body 5, an opening portion 3 for allowing attachment/detachment of the cartridges 16 to/from the rotary 15 of the developing device 11 is provided. When a user mounts the cartridge 16 to the rotary 15 (accommodating portion 44), or removes the cartridge 16 from the rotary 15 (accommodating portion 44), the user causes the cartridge 16 to pass through the opening portion 3 while grasping the cartridge 16. That is, the opening portion 3 is an opening portion for allowing attachment/detachment of the cartridges 16 to/from the rotary 15. The opening portion 3 is provided on the front side with respect to the delivery tray 35. The top surface cover 2 can pivot about the hinge shaft 36 to take a closing state of closing the opening portion 3 and an opening state of opening the opening portion 3. That is, the cover 2 can open and close the opening portion 3. The cover 2 is normally closed, and is opened by a user when the cartridge 16 is attached/detached. When the top surface cover 2 is opened, the opening portion 3 formed in the top surface of the apparatus main body 5 is opened. From the opening portion 3, a cartridge attachment/detachment passage portion 37 leading to the developing device 11 in the apparatus main body 5 is visible. The passage portion 37 includes a guide plate 38 provided between the opening portion 3 and the developing device 11 and curved into a concave arc shape. The passage portion 37 is arranged on the upper side with respect to the drum 8.

Details of the apparatus main body 5 are described (FIG. 4). As described above, the bones of the apparatus main body 5 include the left frame 51, the right frame 52, and a front stay 53 and a rear stay 54 for connecting the right and left frames. The front stay 53 is fixed so as to connect two surfaces, i.e., a front surface and a top surface portion. The rear stay 54 is fixed so as to connect two surfaces, i.e., a rear surface and the top surface portion. A pressing member 55 and a pressing member 56 are fixed with screws onto connecting portions (overlapping portions) between the respective stays and the right or left frame. The structure forming the bones of the apparatus main body 5 includes a through-hole (first through-hole) through which a screw (fixing member) is inserted, the through-hole being formed in the connecting portion at which two members overlap each other. The two members are intimately coupled to each other at the connecting portion by being fastened with a screw.

The top surface portion between the two stays 53 and 54 is open, and serves as the passage portion for the developing cartridges as described above. A front surface portion is open as an access area for the drum unit, and a back surface side is open as an access area for clearing jam.

FIGS. 3A and 3B each illustrate a detailed view of the pressing member. The pressing member 55 includes a fastening portion having screw fixing holes (through-holes) 55*a* formed therein, insertion portions each having a tapered shape 55*c*, and bent portions 55*b*. The pressing member 56 includes a fastening portion having a screw fixing hole (through-hole) 56*a* formed therein, insertion portions each having a tapered shape 56*c*, and bent portions 56*b*. Here, pressing members 55L and 55R illustrated in FIG. 4 each have the same configuration as that of the pressing member 55 illustrated in FIG. 3A. Further, pressing members 561L, 561R, 562L, 562R, and 563L each have the same configuration as that of the pressing member 56 illustrated in FIG. 3B. Although not shown in FIG. 4, a pressing member having the same configuration as that of the pressing member 56 is also fixed at a position bilaterally symmetrical to the pressing member 563L.

On the front left side of the front stay 53, holes (second through-holes) in which the pressing member 561L is inserted are arranged between front stay abutment surfaces (abutment portions) 531L and 532L (FIG. 8, FIG. 11). The holes are arranged at upper and lower two positions around the through-hole (first through-hole) in which a screw is fastened, and pass through the front stay 53 and the left frame 51. Through-holes (second through-holes) constituted by front stay fixing holes 535L and 536L and left frame fixing holes 511 and 512 are shifted in the right-left direction, and left ends E1 and E3 of the front stay fixing holes 535L and 536L and right ends E2 and E4 of the left frame fixing holes 511 and 512 define widths W1 of the through-holes. Tapered portions (insertion portions) of the pressing member 561L are inserted into the through-holes (two points), and the pressing member 561L is pushed in with a screw until backlash is eliminated. Each of the tapered portions of the pressing member 561L has such a shape that a width in an abutting direction of the abutment surfaces 531L and 532L decreases toward a direction of insertion into the through-hole. The front stay abutment surfaces 531L and 532L provided to the front stay (one member) 53 abut on the left frame (the other member) 51 in a direction parallel to a contact surface between the two members. That is, each of the tapered portions of the insertion portions of the pressing member 561L has such a shape that a width in a direction (direction parallel to the contact surface between the two members) intersecting an inserting direction of the screw increases. Thus, when the insertion portions are inserted into the through-holes, the front stay 53 and the left frame 51 are pressed by the pressing member 561L in the direction intersecting the inserting direction of the screw, and then the left frame 51 abuts on the front stay abutment surfaces 531L and 532L. Therefore, under a state in which the abutment surfaces 531L and 532L are abutted on the left frame 51 and the insertion portions are fitted into the through-holes without gaps in the abutting direction, the two members are fastened, thereby enabling fixation without backlash. At this time, there is required a taper of the pressing member for allowing variations in hole size resulting from dimensional tolerance. A portion having the same dimension as the width W1 of the through-hole in a range between a minimum width $W_{min}$ and a maximum width $W_{max}$ of the pressing member defines a pushed-in amount. The pressing member 561L is configured so that the tapered portions can be elastically displaced by the bent portions in the direction of insertion relative to the fastening portion. After backlash is eliminated, deformation of the bent portions can absorb an over stroke (FIG. 11). That is, the pressing member 561L deforms from a position P1 before the bending to a position P2 after the bending by deforming the bent portion by an amount D of the bending. Owing to the deformation of the bent portions, the tapered portions are fitted into the second through-holes while being urged in the direction of insertion.

A case where large load is applied to the left frame 51 and the front stay 53 is described. In a case where two components abut on each other through stronger contact, a positional accuracy between the two components is less likely to change. Assuming a case where such two components are separated from each other, the effect is described with reference to FIGS. 9A and 9B. FIG. 9A is a view illustrating a case where the pressing member 561L is not provided. When load is applied in directions indicated by arrows F1 and F2 of FIG. 9A, the front stay abutment surface 532 is separated from the left frame 51. A direction of the load applied to the left frame 51 is indicated by the arrow F1, and a direction of the load applied to the front stay 53 is indicated by the arrow F2. In other words, a width of the through-hole is narrowed. In a case where the pressing member 561L is not provided in the through-hole, holding is performed with a fixing force of the screw, but the force is determined by an intimate contact force and a coefficient of friction between members. Thus, the holding is unstable and has a small holding force. For example, in a case of an M3 screw, a holding force of about 20 kgf is attained. When this value is exceeded, slippage suddenly occurs. FIG. 9B is a view illustrating a case where the pressing member 561L is provided. When the pressing member is provided, the pressing member is fixed without a gap in the through-hole portion to be narrowed, and hence holding is controlled by not the fixing force of the screw but a mechanical property of a member to be inserted. By inserting a metal component formed of a steel plate into the pressing member 561L, a large fixing force can be obtained. For example, in a case of a t1 steel plate, even when load of about 80 Kgf is applied, no slippage occurs. Only one insertion portion of the pressing member can provide a holding performance equivalent to four or more screws. In this configuration, by fixing the pressing member 561L with one screw, two insertion portions provide a holding force of about 160 Kgf equivalent to eight screws.

The configuration of the front right side of the front stay 53 is the same as that of the above-mentioned front left side (bilaterally symmetrical configuration), and hence description thereof is omitted.

On the top left side of the front stay 53, shapes for inserting the pressing member 55L are arranged between abutment surfaces 533L and 534L of the front stay 53 (FIG. 10). The shapes are formed at two positions interposing two screws for fixing the pressing member 55L therebetween, and pass through the front stay and the left frame. Left ends E7 and E5 of front stay fixing holes 537L and 538L and right ends E8 and E6 of left frame fixing holes 513 and 514 define widths W2 of the through-holes. In this embodiment, the front stay fixing holes 537L and 538L are constituted by one through-hole. Two through-holes (fixing holes 513 and 514) formed in the left frame overlap the one through-hole of the front stay. That is, in the one through-hole of the front stay, a portion overlapping the left frame fixing hole 513 serves as the front stay fixing hole 537L, and a portion overlapping the left frame fixing hole 514 serves as the front stay fixing hole 538L. The present invention is not limited to this configuration. For example, two through-holes may be provided also in the front stay so as to correspond respectively to the two through-holes provided in the left frame.

Tapered portions of the pressing member 55L are inserted into the through-holes (two points), and the pressing member is pushed in with a screw until backlash is eliminated. It is possible to effect fixation without backlash while the abutment surfaces 533L and 534L of the front stay 53 abut on the left frame 51. At this time, there is required a taper of the pressing member for allowing variations in hole size resulting from dimensional tolerance. The bent portions absorb the over stroke after backlash is eliminated (FIGS. 3A and 3B).

The configuration of the top right side of the front stay 53 is the same as that of the above-mentioned top left side (bilaterally symmetrical configuration), and hence description thereof is omitted.

On the top left side of the rear stay 54, holes in which the pressing member 562L is inserted are arranged between abutment surfaces 541L and 542L of the rear stay 54. The holes are formed at front and rear two positions around a screw, and pass through the rear stay 54 and the left frame 51. Through-holes constituted by rear stay fixing holes 544L and 545L and left frame fixing holes 515 and 516 are shifted in the right-left direction, and left ends of the rear stay fixing holes 544L and 545L and right ends of the left frame fixing holes 515 and 516 define widths of the through-holes. Tapered portions of the pressing member 562L are inserted into the through-holes (two points), and the pressing member 562L is pushed in with a screw until backlash is eliminated. It is possible to effect fixation without backlash while the rear stay abutment surfaces 541L and 542L abut on the left frame 51. The present invention has such a feature that the rear stay abutment surfaces 541L and 542L are not arranged on the same surface of the product, but are arranged respectively on two surfaces, i.e., the top surface portion of the product and the back surface portion of the product. Although the rear stay abutment surfaces 541L and 542L are not arranged on the same surface, close arrangement of the two surfaces can provide the same holding effect as that in a case of arrangement on the same surface.

The configuration of the top right side of the rear stay 54 is the same as that of the above-mentioned top left side (bilaterally symmetrical configuration), and hence description thereof is omitted.

On the back left side of the rear stay 54, holes in which the pressing member 563L is inserted are arranged between abutment surfaces 542L and 543L of the rear stay 54. The holes are formed at upper and lower two positions around a screw, and pass through the rear stay 54 and the left frame 51. Through-holes constituted by rear stay fixing holes 546L and 547L and left frame fixing holes 517 and 518 are shifted in the right-left direction, and right ends of the rear stay fixing holes 546L and 547L and left ends of the left frame fixing holes 517 and 518 define widths of the through-holes. Tapered portions of the pressing member 563L are inserted into the through-holes (two points), and the pressing member 563L is pushed in with a screw until backlash is eliminated. It is possible to effect fixation without backlash while the abutment surfaces 542L and 543L of the rear stay 54 abut on the left frame 51. The present invention has such a feature that another rear stay abutment surface 548L is arranged between the rear stay abutment surfaces 542L and 543L. The rear stay abutment surfaces 542L and 543L are located at a distance of about 65 mm, and hence the rear stay abutment surface 548L is arranged near the middle of the abutment surfaces 542L and 543L in order to secure the positional accuracy. In a case of clearly securing the position, it is necessary to provide the abutment surface 548L with some gap with respect to the left frame 51. However, in this embodiment, variations resulting from tolerance are less likely to affect performance, and hence the abutment surface 548L is provided on the same surface.

The configuration of the back right side of the rear stay 54 is the same as that of the above-mentioned back left side (bilaterally symmetrical configuration), and hence description thereof is omitted.

With reference to FIG. 8, positions of the abutment portions and the pressing member are described using the front left portion. In this configuration, a distance A (distance between the abutment surface 531L and a screw center of the pressing member 561L) and a distance B (distance between the abutment surface 532L and the screw center of the pressing member 561L) are substantially equal. A holding force equivalent to two insertion portions (portions to be inserted) is required, and hence the insertion portions are arranged around a screw at a substantially equal distance from the screw center, that is, the insertion portions are arranged symmetrically so as to be parallel to an aligning direction of the two abutment portions. If a holding force equivalent to one insertion portion is required, the one insertion portion can be located at a substantially equal distance from the two abutment surfaces 531L and 532L.

As described above, according to this embodiment, when abutting and fixing two plate members at a predetermined position, it is possible to effect fixation without backlash while securing abutment.

When fixing two steel materials, it is important to effect fixation with high accuracy and without backlash. However, when, in order to secure the accuracy, adopting a configuration in which a positioning portion and a fixing portion are separated from each other, backlash is required for the fixing portion, and there is a risk in that the positional accuracy is deteriorated due to an external force by an amount of backlash for the fixing portion. When using the fixing portion as the positioning portion, fixation with high accuracy cannot be effected due to a processing accuracy of the fixing portion and an accuracy of a fixing position.

In this embodiment, a through-hole passing through the two steel materials is provided between two abutment portions for the two steel materials. A width of the through-hole is defined by a hole end portion of one of the steel materials and a hole end portion of the other steel material. By pushing the pressing member having a tapered shape into the through-hole, the two abutment portions abut on each other through stronger contact. With this, it is possible to fix two members to each other without backlash while securing abutment between the two members. The pressing member has a bending structure which enables elastic displacement of the insertion portion, and hence the pressing member can easily absorb the over stroke after backlash is eliminated.

Therefore, according to this embodiment, without using special equipment, and without using a special drawn shape, it is possible to fix a side plate and a stay to each other at low cost by inserting the pressing member.

The pressing member 56 allows the tapered portions to be inserted into two holes with one screw, and hence is advantageous in cost. Further, the pressing member 56 has such an advantage as to occupy a small space even when adding a space for a screw. If there is no limitation on nearby components, that is, there is no limitation particularly on a space for fixing the pressing member, arrangement of the pressing member 56 is effective.

Meanwhile, regarding the pressing member 55, the tapered portions are inserted into two holes with two screws, and hence cost of the pressing member 55 is higher than that of the pressing member 56. However, in a case of a configuration of a nearby component that does not allow provision of a screw at a center portion between two tapered portions (for example, a case of a design that has no space in which the through-holes for insertion of the tapered portions can be arranged on both sides of the screw), the pressing member 55 may be used. Using two pressing members 56 can provide the same fixing effect as that in a case of one pressing member 55, but in that case, the cost and assembly work for two pressing members 56 are required. Thus, fixing with one pressing member 55 is more effective.

Further, each of the tapered portions of the insertion portions of the pressing member 56 illustrated in FIG. 3B, which is to be inserted into two frames, has a tapered surface inclined with respect to a screw inserting direction as illustrated in FIG. 3B. On a side opposite to the tapered surface of the insertion portion, there is provided a straight surface parallel to the screw inserting direction. One tapered surface and one straight surface are provided to each of the two insertion portions, and the tapered surfaces or the straight surfaces are point-symmetrical with respect to the screw fixing hole when viewed from the screw inserting direction. The reason why the tapered surfaces and the straight surfaces are arranged as described above is described.

When inserting a screw into the screw fixing hole to fix the two frames, the pressing member 56 is rotated in association with rotation of the screw, and the two insertion portions are brought into contact with inner surfaces of the holes of the two frames. In this state, the insertion portions are inserted into the holes while sliding on the inner surfaces of the holes. Since the insertion portions of the pressing member 56 are inserted while sliding on the inner surfaces of the holes, the insertion portions are less likely to be caught in the holes of the frames and are more easily inserted into the holes of the frames in a case where the straight surfaces slide on the inner surfaces of the holes than in a case where the tapered surfaces slide thereon.

Accordingly, in the pressing member 56, the straight surfaces are arranged so that surfaces that are first brought into contact with the inner surfaces of the holes of the frames in association with rotation of the screw constitute the straight surfaces. That is, when viewed from the screw inserting direction, surfaces arranged on the downstream side in the screw rotating direction (clockwise in this embodiment) of the insertion portions at the time of insertion of the screw constitute the straight surfaces, whereas surfaces arranged on the upstream side in the rotating direction of the insertion portions constitute the tapered surfaces.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-175554, filed Aug. 4, 2010 and Japanese Patent Application No. 2011-162024, filed Jul. 25, 2011 which are hereby incorporated by reference herein in their entirety.

What is claimed is:

1. An image forming apparatus, comprising:

a first frame and a second frame to be fixed to each other, the first frame having an abutment portion;

a fixing member inserted into holes respectively formed in the first frame and the second frame, the fixing member fixing the first frame and the second frame to each other, wherein the second frame abuts on the abutment portion of the first frame to determine relative positions of the first frame and the second frame in a direction intersecting an inserting direction of the fixing member; and a pressing member for pressing the first frame and the second frame so that the abutment portion of the first frame abuts on the second frame, wherein the first frame and the second frame are pressed by the pressing member which is urged by the fixing member, and the second frame abuts on the abutment portion of the first frame, wherein the first frame and the second frame each respectively have other holes different from the holes into which the fixing member is inserted, the pressing member has an insertion portion inserted into the other holes, the insertion portion has a shape in which a width of the insertion portion in the direction intersecting the inserting direction of the fixing member increases as the insertion portion is inserted into the other holes, and the insertion portion is configured to be inserted into the other holes as the fixing member is inserted into the holes.

2. An image forming apparatus according to claim 1, wherein, when the insertion portion is inserted into the other holes, the insertion portion presses the abutment portion of the first frame so as to abut on the second frame, and presses the second frame so as to abut on the abutment portion.

3. An image forming apparatus according to claim 1, wherein the insertion portion is able to be elastically displaced with respect to a portion of the pressing member which is pressed by the fixing member, and the pressing member is pressed by the fixing member so that the insertion portion is urged in a direction of insertion into the other holes.

4. An image forming apparatus according to claim 1, wherein the fixing member is a screw.

5. An image forming apparatus according to claim 4, wherein the pressing member has a hole into which the fixing member is inserted.

6. An image forming apparatus according to claim 1, wherein the first frame and the second frame respectively have a plate-like portion in which the hole for insertion of the fixing member is formed, the first frame and the second frame are fixed to each other under a state in which the plate-like portions overlap each other, and the direction intersecting the inserting direction of the fixing member is parallel to a contact surface on which the plate-like portions overlap to be held in contact with each other.

7. An image forming apparatus according to claim 5, wherein the pressing member has another insertion portion.

8. An image forming apparatus according to claim 7, wherein the hole of the pressing member is arranged between the insertion portion and the other insertion portion.

9. An image forming apparatus according to claim 5, wherein the pressing member has another insertion portion and another hole into which a fixing member is inserted.

10. An image forming apparatus according to claim 9, wherein the insertion portion and the other insertion portion are arranged between the hole and the other hole of the pressing member.

11. An image forming apparatus according to claim 1, wherein the insertion portion has a tapered shape.

* * * * *